US009435115B2

(12) United States Patent
Braasch

(10) Patent No.: US 9,435,115 B2
(45) Date of Patent: Sep. 6, 2016

(54) STRUCTURAL ELEMENT FOR HEAT-INSULATING PURPOSES

(75) Inventor: Harald Braasch, Sinzheim (DE)

(73) Assignee: Schöck Bauteile GmbH, Baden-Baden (DE)

( * ) Notice: Subject to any disclaimer, the term of this patent is extended or adjusted under 35 U.S.C. 154(b) by 0 days.

(21) Appl. No.: 14/238,286

(22) PCT Filed: Aug. 13, 2012

(86) PCT No.: PCT/EP2012/065818

§ 371 (c)(1),
(2), (4) Date: Feb. 11, 2014

(87) PCT Pub. No.: WO2013/021069

PCT Pub. Date: Feb. 14, 2013

(65) Prior Publication Data

US 2014/0190108 A1 Jul. 10, 2014

(30) Foreign Application Priority Data

Aug. 11, 2011 (DE) ..... 10 2011 109 958
Aug. 11, 2011 (DE) ..... 10 2011 109 962

(51) Int. Cl.

| | |
|---|---|
| ***E04B 1/68*** | (2006.01) |
| ***E04B 1/76*** | (2006.01) |
| ***E04B 1/00*** | (2006.01) |
| ***E04C 2/284*** | (2006.01) |

(52) U.S. Cl.
CPC ..... *E04B 1/7604* (2013.01); *E04B 1/0038* (2013.01); *E04C 2/284* (2013.01)

(58) Field of Classification Search
CPC ..... E01C 11/02; E01C 11/04; E01C 11/06; E01C 11/12; E04B 1/6812; E04B 1/6813; E01D 19/06
USPC ..... 52/395, 396.03, 396.04, 396.06, 404.1, 52/404.3, 404.4, 406.1–406.3, 741.3; 14/73.1, 73.5
See application file for complete search history.

(56) References Cited

U.S. PATENT DOCUMENTS

| | | | | |
|---|---|---|---|---|
| 4,120,066 | A * | 10/1978 | Leroux | 14/73.1 |
| 5,168,683 | A * | 12/1992 | Sansom et al. | 52/396.04 |
| 8,991,124 | B2 | 3/2015 | Braasch | |
| 2002/0169256 | A1 * | 11/2002 | Merfeld et al. | 525/258 |
| 2010/0095616 | A1 | 4/2010 | Braasch | |

FOREIGN PATENT DOCUMENTS

| | | |
|---|---|---|
| DE | 4009987 | 10/1991 |
| DE | 19640652 | 4/1998 |
| DE | 19741027 | 3/1999 |
| DE | 19627342 | 6/2006 |
| DE | 102006032444 | 1/2008 |
| DE | 102007014922 | 9/2008 |
| DE | 102008029701 | 12/2009 |
| EP | 1225282 | 7/2002 |
| EP | 1564336 | 8/2005 |
| EP | 1892344 | 2/2008 |
| EP | 2177681 | 4/2010 |

* cited by examiner

*Primary Examiner* — William Gilbert
(74) *Attorney, Agent, or Firm* — Volpe and Koenig, P.C.

(57) ABSTRACT

Structural element for heat-insulating purposes between two structural parts, in particular between a building and a projecting exterior part, formed of an insulating body, which is to be arranged between the two structural parts, and of reinforcing elements at least including a load-bearing element which, with the structural element in the installed state, runs through the insulating body substantially horizontally and transversely to the substantially horizontal longitudinal extent of the insulating body, and can be connected at least indirectly to the two structural parts. The load-bearing element has an additional element which encloses the load-bearing element at least in sub-regions, and at least indirectly, and the load-bearing element is produced using a lost mold (1), and the additional element is formed, at least in part, of the lost mold, and wherein the additional element is formed in two or more parts.

13 Claims, 2 Drawing Sheets

STRUCTURAL ELEMENT FOR HEAT-INSULATING PURPOSES

BACKGROUND

The present invention relates to a structural element for thermal insulation.

Such structural elements for thermal insulation are known, for example, from EP-A-1 225 282; here, the additional element comprises a lost mold for a load-bearing element produced from concrete. The mold in turn comprises a plastic shell into which the concrete is filled and with which the concrete is inserted together into the structural element for thermal insulation, such that the mold in the installed state surrounds the concrete load-bearing element on all sides, that is to say also at its end sides facing the adjoining structural parts. This can be used for the purpose that the mold in this region of the end sides forms a sliding layer for the concrete load-bearing element and thus does not prevent any relative movements occurring between load-bearing element and adjoining structural part, but promotes them by improved sliding properties.

However, in a modification of the described prior art, the additional element can also comprise a sliding body which corresponds to the greatest possible extent with respect to the shape of the mold for producing the load-bearing element, but was not involved in the actual production of the load-bearing element, that is to say in the molding. However, as a result of the identical shape as the mold in the part regions which are important for the sliding movement, it is essentially ensured that the sliding body bears over its whole area against the load-bearing element and can make available the same optimized sliding properties as the mold. In this respect, the prior art discloses additional elements which either comprise a lost mold or a sliding body which likewise surrounds the load-bearing element at least in part regions and is installed together with the load-bearing element into the structural element for thermal insulation.

The use of such concrete load-bearing elements which are installed with a plastic layer surrounding them, which plastic layer can comprise a lost mold or a sliding body adapted to the shape of the load-bearing element, has proved itself in practice in the meantime.

Taking this as the starting point, the present invention is based on the object of further improving a structural element for thermal insulation of the type mentioned at the outset and in particular optimizing it in terms of its use and thermal insulation properties.

SUMMARY

This object is achieved by a structural element for thermal insulation according to one or more features of the invention.

Advantageous developments of the invention are in each case the subject matter of dependent claims whose wording is hereby incorporated by express reference in the description in order to avoid unnecessary repetitions of text.

According to the invention, the additional element is formed in two or more parts, permits thereby a modular construction and can thus be adapted by this modular construction exactly to the requirements existing in the respective load-bearing element part regions.

The modular construction is essential to achieve the advantages according to the invention. In this sense, the wording two- or multi-part structure is also to be understood in such a way that the additional element has parts or part regions with different properties, in particular material properties. The wording "part" is thus not to be understood as a physically independent unit but as part (region) of the additional element. Even if the additional element were to be produced in one piece from two or more materials, this complies with the modular construction according to the invention and is considered as meaning in two or more parts in the sense of the present invention.

The modular construction displays its advantages according to the invention especially when the additional element acts on the load-bearing element in the corresponding part regions, thus, for example, the end sides essential for force transmission for improving the sliding properties or, for example, the part regions situated laterally of, above and/or below the load-bearing element for improving the thermal insulating properties or, for example, for better positional fixing or movability in the insulating body; here, however, it is also within the scope of the invention that the additional element or the mold does not act directly on the associated load-bearing element but only indirectly, for example with the interposition of a separating film. It is essential here that the additional element surrounds the load-bearing element at least in part regions and at least indirectly, even if a direct action would be advantageous.

With the two- or multi-part structure according to the invention, the proven advantage of the prior art, namely the production of the load-bearing element using a lost mold, can be still further optimized: if the additional element is formed in two or more parts, it can have, for example in the important part regions, the lost mold with optimized sliding properties and be correspondingly adapted in other part regions to the requirements there, for example have optimized thermal insulating properties.

The advantages according to the invention of the two- or multi-part additional element can be achieved in various ways: thus, in addition to the lost mold, the additional element can have at least one further supplementary element which preferably has nothing to do with the production of the load-bearing element, that is to say with the molding. This supplementary element can be formed, for example, of thermal insulating material, such as, for example, of in particular foamed polyurethane or polystyrene.

However, it is likewise also possible that the lost mold itself is formed in two or more parts. Here, the above-described principle of the modular construction can be applied to the mold and part regions of the mold can be tailored to the respective requirements in the installed state. This is possible both when the additional element comprises only the (multi-part) lost mold and when, in addition to the (multi-part) lost mold, a further supplementary element is provided.

It is furthermore advantageous if, in addition to the lost mold, the load-bearing element is produced using a further, in particular reusable shaping element. Although this is involved in the production of the load-bearing element, it is subsequently removed again therefrom. Its further use is unimportant per se for the load-bearing element, and thus it can be reused, for example, for the production of a further load-bearing element. However, shaping elements are also conceivable which are destroyed during removal from the load-bearing element.

If, for example, the load-bearing element has to carry out or follow relative movements with respect to the adjoining structural part, it is then recommended if the additional element and/or the mold in the bearing region between load-bearing element and structural part is formed in the manner of a sliding element known per se in the form of a sliding layer or sliding plate, wherein the additional element and/or the mold can be formed, for example, of HD polyethylene in this part region.

By contrast, no relative movements which make it necessary to interpose a sliding layer generally take place in the region of the insulating body at the lateral surfaces of the load-bearing element; instead, what is important in these lateral regions of the insulating body is a particularly good thermal insulation property, with the result that the additional element and/or the mold can be formed of a thermal insulating material there, in particular of polyurethane or polystyrene foam. If the abovementioned sliding element of HD polyethylene were also to extend over the entire insulating body region from one end side to the other end side, a heat or cold bridge would thereby be formed, with the result that the thermal insulation properties made available by the additional element and/or the mold would be considerably more unfavorable than in the described case according to the invention in which the additional element and/or the mold comprises a thermal insulating material in the region of the insulating body.

Here, on the one hand, the additional element and/or the mold can be produced by common shaping methods, such as, for example, injection molding or coextrusion of different materials in order thereby to form, for example, a uniform and self-enclosed body which can be formed, for example, in a cup-shaped manner. On the other hand, the additional element and/or the mold can also be formed by assembly of different components, wherein this assembly can take place, for example, cohesively or by joining methods such as adhesive bonding. However, it is likewise also possible that the assembly takes place by the load-bearing element material itself, namely if the load-bearing element material is cured or set and thus bears the components of the mold which adhere to the load-bearing element material.

In this context, it is moreover advantageous if two (or more) components of an additional element or a mold which correspond to one another in terms of material, function and/or position are connected to one another via a connecting element. Thus, in other words, it could be possible, for example, for the two components arranged at the ends, which components serve to absorb relative movements between load-bearing element and adjoining structural part, to be connected to one another via a common connecting element, which already ensures that this connecting element predetermines the mutual spacing of these two components and hence also immediately defines the length of the load-bearing element produced in the mold.

It is also within the scope of the present invention that two adjacent load-bearing elements have a common mold, with the result that the modular structure mentioned can be optimized to the extent that larger load-bearing element units can be formed which in turn, owing to their size and the number of the load-bearing elements enclosed thereby, improve the stability of the mold.

BRIEF DESCRIPTION OF THE DRAWINGS

Further features and advantages of the present invention will emerge from the following description of an exemplary embodiment with reference to the drawing, in which.

DETAILED DESCRIPTION OF THE PREFERRED EMBODIMENTS

Figure 1A:
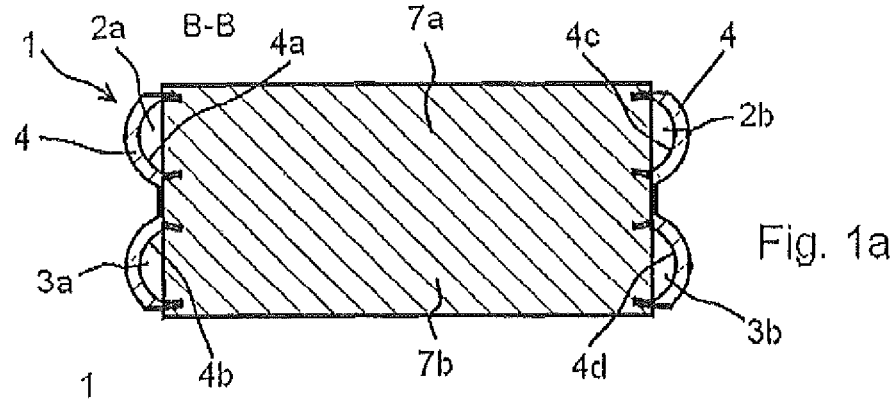
FIGS. 1*a*-1*d* show an additional element with a mold of a structural element for thermal insulation according to the invention in FIG. 1*d* in a perspective plan view, in FIG. 1*b* in a vertical section, in FIG. 1*a* in a horizontal section along the plane B-B from FIG. 1*b* and in FIG. 1*c* in a horizontal section along the plane A-A from FIG. 1*b;*
Figure 1B:
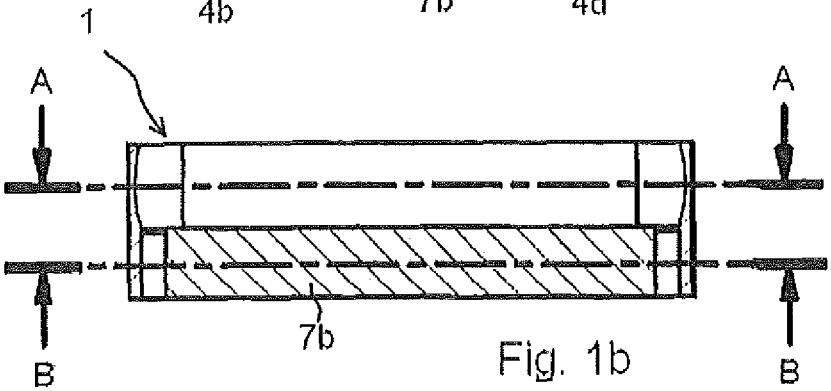
Figure 1C:
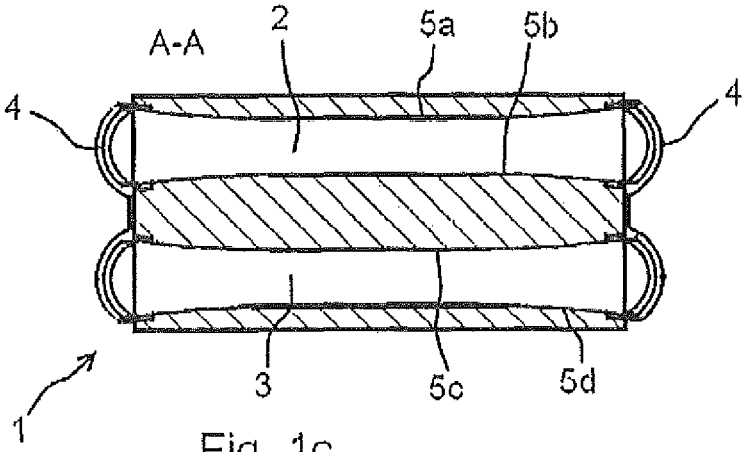
Figure 1D:
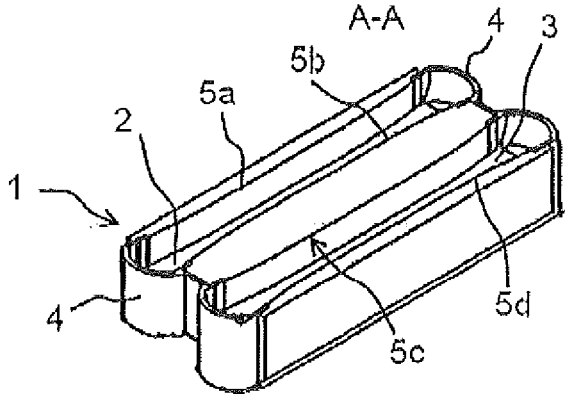

FIG. 1 illustrates an additional element which comprises a mold 1 which serves for forming a total of two concrete load-bearing elements (not shown) for a structural element (likewise not shown) for thermal insulation, which is marketed, for example, under the designation "Isokorb® with HTE module". The mold circumscribes two cavities 2, 3 for the load-bearing elements, which cavities are surrounded by corresponding walls of the mold 1: the cavities 2, 3 are of elongate design with a constriction in horizontal section, i.e. a width which changes somewhat over their length (they are wider at their free ends and they are somewhat narrower in their constricted central region) and at their terminal end sides 2*a*, 2*b* or 3*a*, 3*b*, which form the end sides of the load-bearing elements, have sliding elements 4 which, in the installed state, form the bearing region between load-bearing element on the one hand and adjoining structural part on the other hand and accordingly serve for absorbing relative movements between load-bearing element and adjoining structural part in the horizontal direction, in particular along the gap.

The mold illustrated in FIG. 1 is designed in such a way that the load-bearing elements to be produced in it are provided at their end sides with a contact profile which faces the structural part and is convexly curved in horizontal section, wherein the mold then has in the region of this end side 4 in horizontal section a concavely curved force-introduction surface 4*a*, 4*b*, 4*c*, 4*d* oppositely adapted in shape to the contact profile.

In the lateral load-bearing element region outside the sliding elements 4, the walls of the mold 1 are formed of a thermal insulating material of polyurethane foam; these thermally insulating components extend, following the somewhat constricted load-bearing element shape, in a somewhat curved manner through the insulating body plane from one end sliding element 4 to the opposite end sliding element 4 and thus form slightly curved vertical side walls 5*a*, 5*b*, 5*c*, 5*d*.

Two sliding elements 4, 4 which are arranged on the mutually opposite end sides of the concrete load-bearing element to be produced in the mold 1 are connected to one another via a common bar-shaped connecting element (not shown in the drawing), with the result that the connecting element predetermines the length of the associated load-bearing element. Likewise, mutually opposite side walls 5*a*, 5*b* on the one hand and 5*c*, 5*d* on the other hand are connected to one another via a connecting element in the form of the polyurethane foam underside 7*a*, 7*b* of the mold, so that as a result the width of the load-bearing element to be produced in the mold is predetermined and maintained without the spacing of the side walls being changed by the pressure of the concrete material during filling of the concrete material.

It can easily be seen from the drawing that a load-bearing element to be produced in the mold 1 has regions with different functions and that thus a mold for producing these regions, when the mold is to be installed together with the load-bearing element into the structural element for thermal insulation and is to perform likewise corresponding functions there, the mold has to be constructed with walls adapted thereto. Here, for example in the region of the end sides of the load-bearing element which serve for force introduction and force transmission to the or from the adjoining structural part, the walls at the end sides 4 of the mold, i.e. the force-introduction surfaces 4*a*, 4*b*, 4*c*, 4*d*, should thus be optimized in terms of the sliding properties, whereas the lateral mold side walls 5*a*-5*d*, which are unimportant in terms of force transmission, can be optimized in the region of the insulating body in terms of the thermal insulation properties.

Thus, in the exemplary embodiment according to FIG. 1, although the additional element is constructed only from a lost mold, the additional element is multi-part overall since the mold comprises the force-introduction surfaces 4*a*, 4*b*, 4*c*, 4*d* and the side walls 5*a*-5*d* which are produced from different materials.

Figure 2:
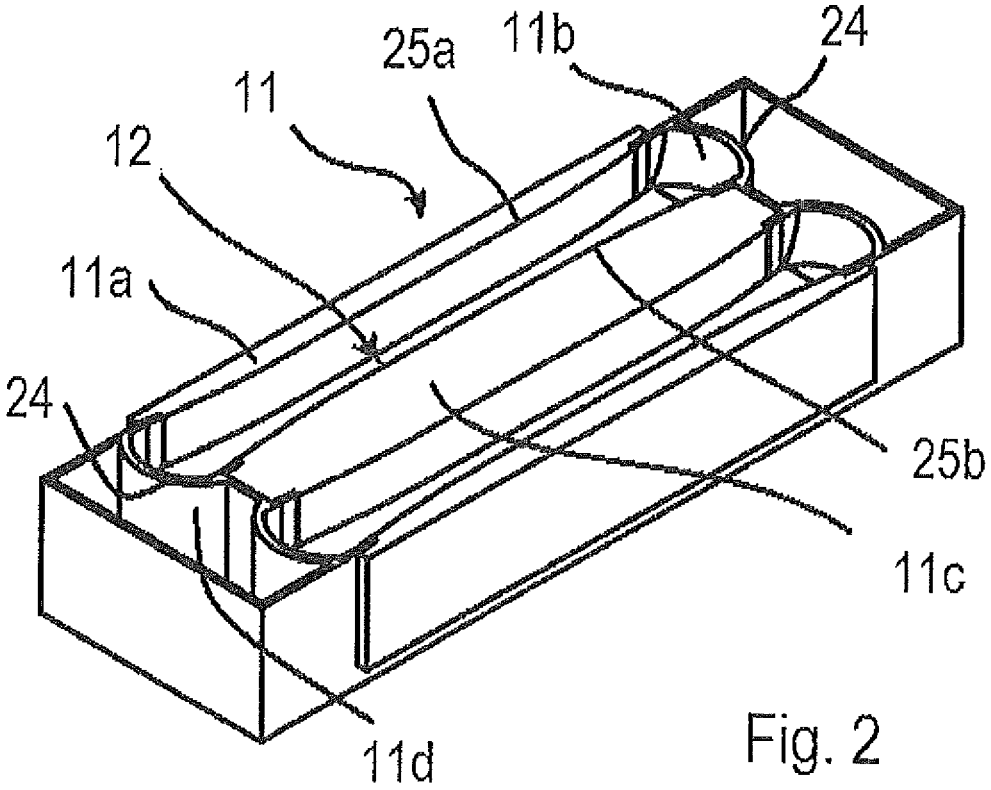
FIG. 2 shows an additional element of a structural element for thermal insulation according to the invention in a perspective side view.

FIG. 2 illustrates an additional element 11 which, together with a concrete load-bearing element, not illustrated in FIG. 2, is used in a structural element for thermal insulation according to the invention, which is likewise not illustrated in FIG. 2. For this purpose, the load-bearing element is arranged in a cavity 12. By contrast to the embodiment according to FIG. 1, the additional element 11 is formed not only of a lost mold, but in total of four parts 11*a*, 11*b*, 11*c* and 11*d*, namely of two lost molds 11*b* and 11*d* and of two supplementary elements 11*a* and 11*c*. The molds 11*b* and 11*d* are provided in the region of end sides 24 of the additional element 11 which are to be selected and designed in terms of their sliding properties. By contrast, the supplementary elements 11*a* and 11*c* constitute the side walls 25*a* and 25*b* of the additional element whose material and shape is to be selected in terms of optimized thermal insulation properties.

Whereas the molds are involved in a shaping capacity in the production of the load-bearing element and as a rule remain on the load-bearing element after production until installation in the structural element for thermal insulation, the supplementary elements are attached only after the production of the load-bearing element. During the production of the load-bearing element, reusable shaping elements are provided as a rule at the lateral part regions of the load-bearing element. These are removed after the production of the load-bearing element and reused for the production of further load-bearing elements.

In summary, the present invention offers the advantage of making available an optimized mold for the production of load-bearing elements in particular formed of a concrete material, which mold has part regions with different functions consisting of a different material adapted to the respective function, so that, as a result, a load-bearing element with surrounding mold is made available which is improved with respect to the previous designs in terms of movability or absorption of movement on the one hand and thermal insulation properties on the other hand.

The invention claimed is:

1. A structural element for thermal insulation between two structural parts, comprising a body, which is to be arranged between the two structural parts, and reinforcing elements at least comprising a load-bearing element which, with the structural element in the installed state, runs through the body transversely to a longitudinal extent of said body, and is connectable at least indirectly to the two structural parts, the load-bearing element has a two or more part additional element which encloses the load-bearing element at least in partial regions and at least indirectly, wherein the load-bearing element is cast into and fills a mold, and the two or more part additional element comprises at least partially the mold, and the two or more part additional element, in a side region of the load-bearing element, includes sidewalls which are made from heat-insulating material against which sides of the load-bearing element are formed, the load-bearing element has contact profiles at opposite end sides thereof facing respective ones of the two structural parts, and at least one of the two or more part additional element or the mold that at least partially comprises the at least two or more part additional element at least indirectly surrounds the load-bearing element in regions of the contact profiles and provides a sliding layer.

2. The structural element as claimed in claim 1, wherein the mold is formed in two or more parts.

3. The structural element as claimed in claim 1, wherein in addition to the mold, the two or more part additional element includes at least one further supplementary element.

4. The structural element as claimed in claim 1, wherein in addition to the mold, the load-bearing element is produced using a further shaping element.

5. The structural element as claimed in claim 1, wherein the load-bearing element is formed of at least one of a curing or settable filling material.

6. The structural element as claimed in claim 5, wherein the filling material comprises a cement-containing, fiber-reinforced building material, high strength or ultra-high-strength concrete, high-strength or ultra-high strength mortar, a synthetic resin mixture, or a reaction resin.

7. The structural element as claimed in claim 1, wherein at least one of the two or more part additional element or the mold that at least partially comprises the two or more part additional element is formed of HD polyethylene as the sliding layer.

8. The structural element as claimed in claim 1, wherein the load-bearing element has at an end side thereof a contact profile which faces one of the two structural parts and is concavely or convexly curved in at least one of a vertical section or a horizontal section, and at least one of the two or more part additional element or the mold has a convexly or concavely curved surface oppositely adapted in shape to the contact profile in at least one of a vertical section or a horizontal section.

9. The structural element as claimed in claim 1, wherein at least one of the two or more part additional element or the mold is produced at least partially by injection molding or coextrusion of two or more materials.

10. The structural element as claimed in claim 1, wherein at least one of the two or more part additional element or the mold is formed by an assembly of two or more components, said assembly is formed at least one of cohesively, by adhesive bonding or by the load-bearing element material filled into the additional element or the mold.

11. The structural element as claimed in claim 10, wherein two components of at least one of the two or more part additional element or the mold which correspond to one another in terms of at least one of material, function or position are connected to one another via a connecting element.

12. The structural element as claimed in claim 1, wherein two adjacent load-bearing elements have at least one of a common one of the two or more part additional elements or a common mold.

13. A method of carrying a compressive load between two structural parts, comprising:

forming a structural element according to claim 1 by casting the load-bearing element in the mold, with the two or more part additional element comprising at least partially the mold; and connecting the structural element at least indirectly to the two structural parts with the sliding layer on the contact profiles at the opposite end sides of the contacting the two structural parts.

* * * * *